US012606926B2

(12) United States Patent
Kim et al.

(10) Patent No.: US 12,606,926 B2
(45) Date of Patent: Apr. 21, 2026

(54) SURFACE TREATMENT METHOD OF ALUMINUM MATERIAL

(71) Applicant: SAMSUNG ELECTRONICS CO., LTD., Suwon-si (KR)

(72) Inventors: Jinju Kim, Suwon-si (KR); Kyunghwan Lee, Suwon-si (KR); Cheolhee Cho, Suwon-si (KR); Youngdeog Koh, Suwon-si (KR); Kwangjoo Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 18/377,658

(22) Filed: Oct. 6, 2023

(65) Prior Publication Data

US 2024/0035188 A1 Feb. 1, 2024

Related U.S. Application Data

(63) Continuation of application No. PCT/KR2022/006746, filed on May 11, 2022.

(30) Foreign Application Priority Data

Jun. 3, 2021 (KR) ..... 10-2021-0071889
Sep. 13, 2021 (KR) ..... 10-2021-0121894

(51) Int. Cl.
*C25D 5/44* (2006.01)
*C23F 1/20* (2006.01)
(Continued)

(52) U.S. Cl.
CPC ..... *C25D 11/246* (2013.01); *C23F 1/20* (2013.01); *C25D 11/16* (2013.01); *C25D 11/243* (2013.01)

(58) Field of Classification Search
CPC ..... C25D 5/44; C25D 11/08; C25D 11/14; C25D 11/16; C25D 11/18; C25D 11/243; C25D 11/246
(Continued)

(56) References Cited

U.S. PATENT DOCUMENTS 5,417,819 A * 5/1995 Askin ..... C25F 3/20 252/79.3
10,662,544 B2 5/2020 Peng et al.
(Continued)

FOREIGN PATENT DOCUMENTS

CN 103046099 A 4/2013
CN 104691053 A 6/2015
(Continued)

OTHER PUBLICATIONS

Kuo et al., "Batch and Spot Repairs for Color-Anodized Panels," Plating and Surface Finishing (Jul. 1, 2005), vol. 92, No. 7, pp. 34-37. (Year: 2005).*
(Continued)

*Primary Examiner* — Edna Wong
(74) *Attorney, Agent, or Firm* — Sughrue Mion, PLLC

(57) ABSTRACT

Disclosed is a method of treating a surface of an aluminum material, the method including: degreasing an aluminum material; etching the degreased aluminum material; performing a first desmutting treatment by immersing the etched aluminum material in a 25-35 wt % nitric acid solution at a temperature in a range of 25 to 30° C. for at least 60 seconds; performing a second desmutting treatment by immersing the first desmutting-treated aluminum material in a 5-15 wt % nitric acid solution at a temperature in a range of 25 to 30° C. for a time in a range of 30 seconds to 60 seconds; anodizing the second desmutting-treated alumi-
(Continued)

num material; coloring the anodized aluminum material; and sealing the colored aluminum material.

11 Claims, 13 Drawing Sheets

(51) Int. Cl.

| | |
|---|---|
| ***C25D 11/08*** | (2006.01) |
| ***C25D 11/14*** | (2006.01) |
| ***C25D 11/16*** | (2006.01) |
| ***C25D 11/18*** | (2006.01) |
| ***C25D 11/24*** | (2006.01) |

(58) Field of Classification Search
USPC ..... 205/202, 213, 214
See application file for complete search history.

(56) References Cited

U.S. PATENT DOCUMENTS

| | | | | |
|---|---|---|---|---|
| 2010/0129697 | A1* | 5/2010 | Jeon | C23G 1/088 429/514 |
| 2011/0233064 | A1* | 9/2011 | Komatsu | C25D 11/18 205/152 |
| 2016/0129853 | A1 | 5/2016 | Kulas et al. | |
| 2019/0143666 | A1* | 5/2019 | Nakamura | B41N 1/083 430/278.1 |

FOREIGN PATENT DOCUMENTS

| | | | | | |
|---|---|---|---|---|---|
| CN | 105986294 | A | | 10/2016 | |
| CN | 109837577 | A | | 6/2019 | |
| CN | 109913924 | A | | 6/2019 | |
| CN | 110095958 | A | * | 8/2019 | G03G 5/06 |
| CN | 110195244 | A | * | 9/2019 | H05K 3/188 |
| EP | 2 350 356 | B1 | | 4/2013 | |
| JP | 06191173 | A | * | 7/1994 | B41N 1/08 |
| JP | 2001-348696 | A | | 12/2001 | |
| JP | 2003-183889 | A | | 7/2003 | |
| JP | 2006-111894 | A | | 4/2006 | |
| JP | 6499930 | B2 | | 4/2019 | |
| KR | 10-1994-0014904 | A | | 7/1994 | |
| KR | 10-0484314 | B1 | | 5/2005 | |
| KR | 10-2010-0085702 | A | | 7/2010 | |
| KR | 20100085702 | A | * | 7/2010 | C09B 1/467 |
| KR | 10-1720116 | B1 | | 4/2017 | |
| KR | 10-1790975 | B1 | | 10/2017 | |
| KR | 10-1786733 | B1 | | 11/2017 | |
| KR | 10-1813108 | B1 | | 12/2017 | |
| KR | 10-1872436 | B1 | | 7/2018 | |
| KR | 10-2174256 | B1 | | 11/2020 | |
| KR | 102242764 | B1 | * | 4/2021 | C25D 11/246 |
| WO | WO-2004063427 | A1 | * | 7/2004 | C23F 3/03 |

OTHER PUBLICATIONS

Communication issued Nov. 14, 2024 by the European Patent Office in European Patent Application No. 22816340.8.
Communication issued Feb. 10, 2025 by the European Patent Office in European Patent Application No. 22816340.8.

* cited by examiner

FIG. 2

| |
|---|
| CLEAR COAT |
| COLOR BASE COAT |
| PRIMER |
| ALUMINUM RAW MATERIAL |

FIG. 9

| |
|---|
| CLEAR COAT |
| COLOR BASE COAT |
| PRIMER |
| ANODIZED FILM |
| ALUMINUM RAW MATERIAL |

SURFACE TREATMENT METHOD OF ALUMINUM MATERIAL

CROSS-REFERENCE TO RELATED APPLICATIONS

This application is a Bypass Continuation Application of PCT International Application No. PCT/KR2022/006746, filed on May 11, 2022, which is based on and claims priority to Korean Patent Application No. 10-2021-0071889, filed on Jun. 3, 2021, and Korean Patent Application No. 10-2021-0121894, filed on Sep. 13, 2021, both of which were filed in the Korean Intellectual Property Office, and the disclosures of which are incorporated by reference herein in their entireties.

BACKGROUND

1. Field

The present disclosure relates to a surface treatment method of an aluminum material, and more particularly, to a method of treating a surface of an aluminum material to improve surface hardness and corrosion resistance thereof.

2. Description of Related Art

Superior exterior appearances and excellent surface properties of aluminum materials are difficult to obtain by plating and coating which are conventionally used to realize colors of aluminum materials. Specifically, plating capable of realizing high-gloss metallic surfaces has been used to manufacture general faucets, but there are disadvantages. For example, the colors are limited to inherent colors of metals such as silver and black and corrosion resistance obtained is poor.

Although coating may realize various colors and particulate texture using metallic particles, hardness obtained thereby is very low to the extent of being lower than that of a fingernail of a human and thus it is difficult to obtain long-term corrosion resistance.

For example, faucet products manufactured by coating an aluminum raw material may be scratched by a porcelain bowl, a glass, a sponge, or the like while being used. In the case where the surface of the coating is directly scratched, white rust may be formed as a result of direct exposure of the aluminum raw material.

In the case where a superior exterior appearance and excellent surface properties of an aluminum material are not obtained by surface treatment thereof, customer dissatisfaction increases within several months to several years causing problems of a reduction in reliability of products and financial damages due to additional costs for after sales service.

SUMMARY

To overcome the above-described problems, provided is a method of treating a surface of an aluminum material to improve surface hardness and corrosion resistance thereof.

In accordance with an aspect of the present disclosure, a method of treating a surface of an aluminum material includes: degreasing an aluminum material; etching the degreased aluminum material; performing a first desmutting treatment by immersing the etched aluminum material in a 25-35 wt % nitric acid solution at a temperature in the range of 25 to 30° C. for 60 seconds or more; performing a second desmutting treatment by immersing the first desmutting-treated aluminum material in a 5-15 wt % nitric acid solution at a temperature in the range of 25 to 30° C. for a time in the range of 30 seconds to 60 seconds; anodizing the second desmutting-treated aluminum material; coloring the anodized aluminum material; and sealing the colored aluminum material.

In addition, the degreasing may include cleaning the aluminum material in a solution including a neutral degreasing agent and 3 wt % sulfuric acid at a temperature in the range of 50 to 60° C.

In addition, the etching may include immersing the aluminum material in a 1-3 wt % sodium hydroxide solution at a temperature in the range of 50 to 60° C. for a time in the range of 10 seconds to 20 seconds.

In addition, the anodizing may include immersing the aluminum material in a 23-24 wt % sulfuric acid solution at a temperature in the range of 24 to 26° C. for a time in the range of 5 minutes to 9 minutes and applying a voltage of 12 to 13 V thereto.

In addition, an oxide film formed after the anodizing may have a thickness of 3 to 8 μm.

In addition, the sealing may include immersing the aluminum material in a 3-5 wt % nickel acetate solution at a temperature in the range of 70 to 80° C. for a time in the range of 2 minutes to 4 minutes.

In addition, the method may further include performing a first drying at a temperature in the range of 60 to 70° C. for a time in the range of 10 minutes to 20 minutes after the sealing.

In addition, the method may further include: coating; and performing a second drying at a temperature in the range of 145 to 150° C. for a time in the range of 30 minutes to 60 minutes after the first drying In accordance with another aspect of the present disclosure, a method of treating a surface of an aluminum material includes: degreasing an aluminum material; etching the degreased aluminum material; performing a desmutting treatment on the etched aluminum material; anodizing the desmutting-treated aluminum material by immersing the aluminum material in a 23-24 wt % sulfuric acid solution at a temperature in the range of 24 to 26° C. for a time in the range of 5 minutes to 9 minutes and applying a voltage of 12 to 13 V thereto; coloring the anodized aluminum material; and sealing the colored aluminum material, wherein after the anodizing, an oxide film is formed having a thickness between 3 μm and 8 μm.

In addition, the desmutting treatment may include: performing a first desmutting treatment by immersing the aluminum material in a 25-35 wt % nitric acid solution for 60 seconds or more; and performing a second desmutting treatment by immersing the aluminum material in a 5-15 wt % nitric acid solution for a time in the range of 30 seconds to 60 seconds.

In addition, the degreasing may include cleaning the aluminum material in a solution including a neutral degreasing agent and 3 wt % sulfuric acid at a temperature in the range of 50 to 60° C.

In addition, the etching may include immersing the aluminum material in a 1-3 wt % sodium hydroxide solution at a temperature in the range of 50 to 60° C. for a time in the range of 10 seconds to 20 seconds.

In addition, the sealing may include immersing the aluminum material in a 3-5 wt % nickel acetate solution at a temperature in the range of 70 to 80° C. for a time in the range of 2 minutes to 4 minutes.

In addition, the method may further include: performing a first drying at a temperature in the range of 60 to 70° C.

for a time in the range of 10 minutes to 20 minutes; coating: and performing a second drying at a temperature in the range of 145 to 150° C. for a time in the range of 30 minutes to 60 minutes after the sealing.

In accordance with another aspect of the present disclosure, a method of treating a surface of an aluminum material includes degreasing an aluminum material; etching the degreased aluminum material; desmutting the etched aluminum material; anodizing the desmutted aluminum material; coloring the anodized aluminum material; and sealing the colored aluminum material by immersing the aluminum material in a 3-5 wt % nickel acetate solution at a temperature in the range of 70 to 80° C. for a time in the range of 2 minutes to 4 minutes.

In addition, the desmutting treatment may include: performing a first desmutting treatment by immersing the aluminum material in a 25-35 wt % nitric acid solution for 60 seconds or more; and performing a second desmutting treatment by immersing the aluminum material in a 5-15 wt % nitric acid solution for a time in the range of 30 seconds to seconds.

In addition, the anodizing may include immersing the aluminum material in a 23-24 wt % sulfuric acid solution at a temperature in the range of 24 to 26° C. for 5 minutes to 9 minutes and applying a voltage of 12 to 13 V thereto.

In addition, the degreasing may include cleaning the aluminum material in a solution including a neutral degreasing agent and 3 wt % sulfuric acid at a temperature in the range of 50 to 60° C.

In addition, the etching may include immersing the aluminum material in a 1-3 wt % sodium hydroxide solution at a temperature in the range of 50 to 60° C. for a time in the range of 10 seconds to 20 seconds.

In addition, the method may further include: performing a first drying at a temperature in the range of 60 to 70° C. for a time in the range of 10 minutes to 20 minutes; coating: and performing a second drying at a temperature in the range of 145 to 150° C. for a time in the range of in the range of 30 minutes to 60 minutes after the sealing.

According to the present disclosure, a method of treating a surface of an aluminum material to improve adhesion of a coating material and remove impurities in the aluminum material as much as possible when compared to common coating methods may be provided. In addition, a method of treating a surface of an aluminum material having a superior surface appearance and increased hardness and corrosion resistance may be provided.

However, the effects obtainable by the surface treatment method of an aluminum material according to embodiments of the present disclosure are not limited to the aforementioned effects, and any other effects not mentioned herein will be clearly understood from the following description by those skilled in the art to which the present disclosure pertains.

BRIEF DESCRIPTION OF DRAWINGS

The above and other aspects and features of certain embodiments of the present disclosure will be more apparent from the following description taken in conjunction with the accompanying drawings, in which:

FIG. 2 is a cross-sectional view of an aluminum material after surface treatment according to a conventional method.

FIG. 9 is a cross-sectional view of an aluminum material after surface treatment according to an embodiment of the present disclosure.

DETAILED DESCRIPTION

Figure 1:
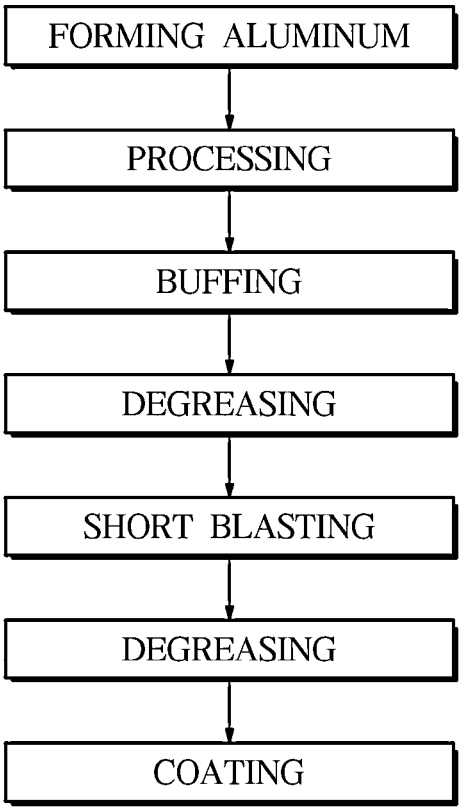
FIG. 1 is a flowchart illustrating a conventional method of treating a surface of an aluminum material.

A method of treating a surface of an aluminum material according to an embodiment of the present disclosure includes degreasing an aluminum material; etching the degreased aluminum material; performing a first desmutting treatment by immersing the etched aluminum material in a 25-35 wt % nitric acid solution at a temperature in the range of 25 to 30° C. for 60 seconds or more; performing a second desmutting treatment by immersing the first desmutting-treated aluminum material in a 5-15 wt % nitric acid solution at a temperature in the range of 25 to 30° C. for a time in the range of 30 seconds to 60 seconds; anodizing the second desmutting-treated aluminum material; coloring the anodized aluminum material; and sealing the colored aluminum material.

Hereinafter, embodiments of the present disclosure will be described. The embodiments of the present disclosure may, however, be embodied in many different forms and should not be construed as being limited to the embodiments set forth herein. Rather, these embodiments are provided so that this disclosure will be thorough and complete, and will fully convey the concept of the disclosure to those skilled in the art.

As used herein, the terms such as "including" or "having" are intended to indicate the existence of features, steps, functions, components, or combinations thereof disclosed in the specification, and are not intended to preclude the possibility that one or more other features, steps, functions, components, or combinations thereof may exist or may be added.

Throughout the specification, it will be understood that when one element, is referred to as being "on" another element, it can be directly on the other element, or intervening elements may also be present therebetween.

Throughout the specification, terms "first", "second", and the like are used to distinguish one component from another, and the components are not limited by these terms.

Meanwhile, unless otherwise defined, all terms used herein have the same meaning as commonly understood by one of ordinary skill in the art to which this disclosure belongs. Thus, these terms should not be interpreted in an idealized or overly formal sense unless expressly so defined herein. For example, the singular forms are intended to include the plural forms as well, unless the context clearly indicates otherwise.

The terms "about", "substantially", etc. used throughout the specification means that when a natural manufacturing and a substance allowable error are suggested, such an allowable error corresponds the value or is similar to the value, and such values are intended for the sake of clear understanding of the present disclosure or to prevent an unconscious infringer from illegally using the disclosure of the present disclosure.

The reference numerals used in operations are used for descriptive convenience and are not intended to describe the order of operations and the operations may be performed in a different order unless the order of operations are clearly stated.

Hereinafter, operating principles and embodiments of the present disclosure will be described with reference to the accompanying drawings.

FIG. 1 is a flowchart illustrating a conventional method of treating a surface of an aluminum material.

Referring to FIG. 1, a conventional method of treating a surface of an aluminum material includes forming an aluminum material. The aluminum material is then processed. After the aluminum material is processed, the aluminum material may be buffed. Then the aluminum material may be degreased, and then may be short blasted. Following the short blasting, the aluminum material may be degreased again. After the degreasing, the aluminum material may be coated.

FIG. 2 is a cross-sectional view of an aluminum material after surface treatment according to a conventional method.

Referring to FIG. 2, a primer layer is formed on an aluminum material after a conventional surface treatment. A color base coat layer is formed on the primer layer, and a clear coat layer is formed on the color base coat layer.

Figure 4:
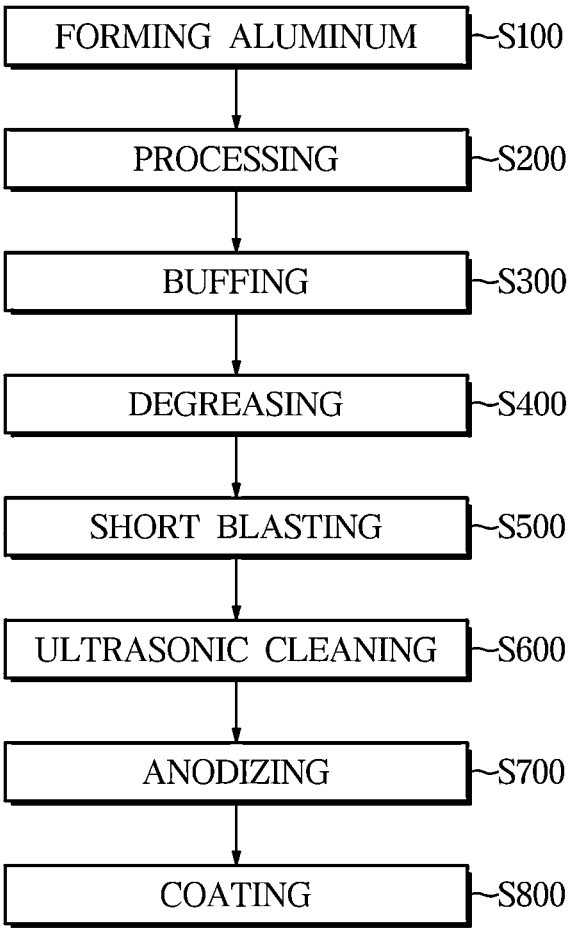
FIG. 4 is a flowchart illustrating a method of treating a surface of an aluminum material according to an embodiment of the present disclosure.

FIG. 4 is a flowchart illustrating a method of treating a surface of an aluminum material according to an embodiment of the present disclosure.

Referring to FIG. 4, the method of treating a surface of an aluminum material according to an embodiment of the present disclosure may include forming (S100) and processing (S200), buffing (S300), degreasing (S400), short blasting (S500), ultrasonic cleaning (S600), anodizing (S700), and coating (S800) an aluminum material. Hereinafter, each of the processes will be described in detail.

S100 may be a process of forming an aluminum material by die casting, extrusion, forging, and the like. S200 may be processing ribs and holes on the formed surface. The aluminum material formed and processed as described above may be subjected to buff (S300) polishing to remove bubbles generated by die casting or improve surface gloss. Subsequently, by the short blasting (S400), particulate texture may be imparted onto the surface and impurities such as bubbles and foreign materials may be removed. Then, the short-blasted surface may be anodized (S700*f*).

Figure 5:
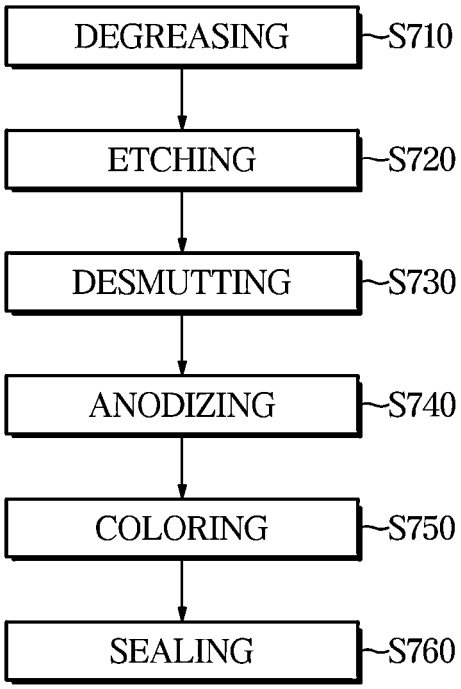
FIG. 5 is a flowchart specifically illustrating S700 of FIG. 1.

FIG. 5 is a flowchart specifically illustrating S700 of FIG. 1.

Anodizing is an electrochemical process of forming a uniform, thick oxide film on the surface of a metal such as aluminum by immersing the metal in a liquid-phase electrolyte and then supplying a current by using the metal as an anode and an auxiliary electrode as a cathode.

An anode refers to an electrode in which oxidation occurs and opposite to a cathode in which reduction occurs. Oxidation refers to a phenomenon in which a metal element chemically binds to oxygen. Therefore, electrochemical growth of an oxide film via oxidation occurring on the surface by using the metal as an anode in a solution is referred to as anodic oxidation, i.e., anodizing.

Most metals exist as oxides in nature. That is, a stable phase is an oxide, and a metal is not a stable phase, but a metastable phase in nature.

For stable existence of a metal as a metastable phase, a protective oxide film naturally formed on the surface of the metal is required. The reason why a highly reactive metal such as aluminum is used stably in the air is that a native oxide film formed on the surface of the metal protects the metal.

In general, corrosion resistance of a metal depends on density and chemical stability of a native oxide film formed on a surface of a metal. The anodizing may be an electrochemical process of artificially increasing a thickness of the oxide film on the surface to protect the metal in the case where corrosion resistance is not sufficient due to a too thin native oxide film.

Referring to FIG. 5, S700 may include degreasing an aluminum material (S710), etching the degreased aluminum material (S720), desmutting the etched aluminum material (S730), anodizing the desmutted aluminum material (S740), coloring the anodized aluminum material (S750), and sealing the colored aluminum material (S760).

S710 may be a degreasing process to clean the surface of the aluminum material and remove residual organic impurities. In an embodiment, the degreasing may include cleaning in a solution including a neutral degreasing agent and 3 wt % sulfuric acid ($H_2SO_4$).

S720 may be etching to remove inorganic impurities present on the surface of or in the aluminum material degreased in S710. In an embodiment, the etching may include immersing the aluminum material in a 1-3 wt % sodium hydroxide (NaOH) solution at a temperature in the range of 50 to 60° C. for a time in the range of 10 seconds to 20 seconds.

S730 may be a desmutting process to remove inorganic impurities remaining on the surface of the aluminum material etched in S720. In an embodiment, the desmutting process may be a double desmutting process including a first desmutting treatment and a second desmutting treatment. The a second desmutting treatment may be performed by immersing the first desmutting-treated aluminum material in a 5-15 wt % nitric acid solution at a temperature in the range of 25 to 30° C. for a time in the range of 30 seconds to 60 seconds.

Although a single desmutting process is performed conventionally, inorganic impurities may remain on the surface by the single desmutting process. Particularly, in the case of die-cast aluminum materials, a content of impurities is relatively high, and thus it is difficult to completely remove inorganic impurities from the surface of the material by performing desmutting only once.

Impurities remaining on the surface of a material may inhibit formation of pores during a subsequent anodizing process to cause stains and non-uniform color, thereby causing a problem of deteriorating surface quality. In addition, in the case where formation of pores is inhibited during the anodizing process, it is difficult to form anchors.

According to an embodiment of the present disclosure, after removing impurities from the surface and applying a swelling effect to residual impurities by the first desmutting treatment, the impurities swelled by the first desmutting treatment may be removed more easily by the second desmutting treatment. Accordingly, inhibition of pore formation may be prevented during the subsequent anodizing process, thereby obtaining superior quality.

In this case, the first desmutting treatment may be performed in a 25-35 wt % nitric acid ($HNO_3$) solution at a temperature in the range of 25 to 30° C. for 60 seconds or more.

With a concentration of the nitric acid solution less than 25 wt %, a problem of increasing a processing time may occur due to insufficient reaction with impurities on the surface and smuts formed on the surface may not be effectively removed. On the contrary, with a concentration of the nitric acid solution more than 30 wt %, not only impurities but also the raw material may be damaged resulting in formation of pin holes and pits. Meanwhile, in the case where the treatment is performed for less than 60 seconds, impurities may not be sufficiently removed and the swelling effect on residual impurities may be reduced.

In this regard, the second desmutting treatment may be performed by immersing the first desmutting-treated aluminum material in a 5-15 wt % nitric acid ($HNO_3$) solution at a temperature in the range of 25 to 30° C. for a time in the range of 30 seconds to 60 seconds.

Considering that the effect on eliminating impurities may be saturated and the raw material may be damaged, the concentration of nitric acid during the second desmutting treatment may be from 5 to 15 wt %, which is lower than that of the first desmutting treatment. Meanwhile, in the case where a second desmutting treatment time is less than 30 seconds, it is difficult for effective collision between the raw material and the acid to proceed sufficiently, so that there is insufficient time for reaction. On the contrary, in the case where the second desmutting treatment time exceeds 60 seconds, manufacturing costs increase and manufacturing competitiveness may decrease.

S740 may be an anodizing process to obtain physical properties by forming an anodized film with a minimum thickness and an increased pore diameter as an underlayer of the coating.

Figure 3:
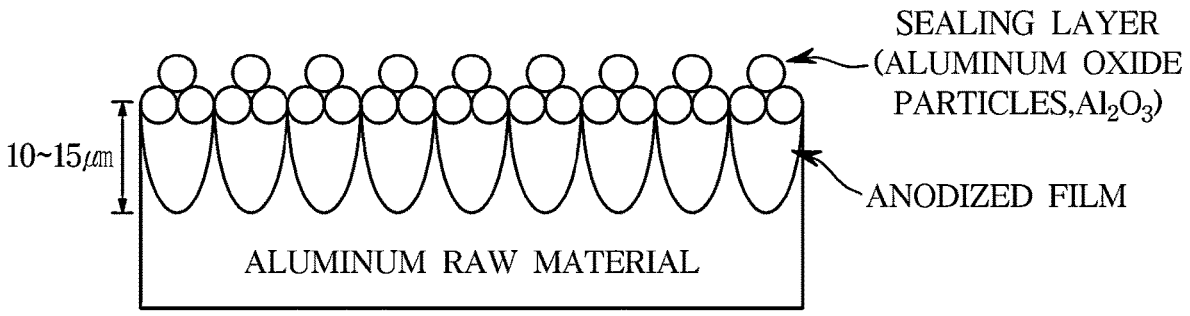
FIG. 3 is a schematic diagram illustrating an anodized film of an aluminum material after anodizing according to a conventional method.

FIG. 3 is a schematic diagram illustrating an anodized film of an aluminum material after anodizing according to a conventional method.

Referring to FIG. 3, it is confirmed that full sealing was conventionally performed by reducing diameters of pores as much as possible by hard anodizing. In the case of parts manufactured by performing anodizing as a final process, hard anodizing was performed to prevent discoloration of a dye permeating into pores and to improve scratch resistance of the surface of the anodized film. For example, conventionally, anodizing was performed by lowering a temperature to 18 to 20° C. and increasing a voltage to 16 to 18 V to reduce the diameter of pores as much as possible.

However, the anodizing according to an embodiment of the present disclosure, unlike the conventional process, may be performed by soft anodizing capable of increasing diameters of pores such that a coating material may permeate into the pores. In the anodizing according to another embodiment of the present disclosure, pores with diameters twice or more than those of the conventional process may be formed by lowering the temperature of the sulfuric acid solution and increasing the voltage applied thereto. That is, adhesion of a coated layer may further be improved by increasing the diameters of pores, and physical properties may be obtained by forming the anodized film having a minimum thickness and increased pore diameters as a underlayer of the coating.

The anodizing according to another embodiment of the present disclosure may include a process of immersing in a 23-24 wt % sulfuric acid solution at a temperature in the range of 24 to 26° C. for a time in the range of 5 minutes to 9 minutes and applying a voltage of 12 to 13 V.

In the case where the anodizing is performed for less than 5 minutes, a sufficient number of pores is not obtained due to insufficient time for pore formation and excellent corrosion resistance, comparted to conventional coating, may not be obtained due to a too thin film, and an anchor effect of the coating material is also reduced.

On the contrary, in the case where the anodizing is performed for more than 9 minutes, pores become deeper and narrower causing difficulties in conditions for permeation of a coating material resulting in a decrease in adhesion to the coating material, which is an organic material, although the environment is suitable for growing pores.

A thinner oxide film than that of the conventional process may be formed by adjusting the temperature and concentration of the sulfuric acid solution, voltage applied thereto, and anodizing time as described above. According to an embodiment of the present disclosure, by controlling the thickness of the oxide film formed after anodizing to 3 to 8 μm, the anodized film functionally serves as an underlayer of the coated layer protecting the raw material and also prevents manufacturing costs from increasing.

The oxide film is formed of a porous layer having a plurality of pores, and S750 may be a process of coloring the porous layer with a coating material by coloring methods such as organic material coloring, inorganic material coloring, and electrolytical coloring.

Figure 6:
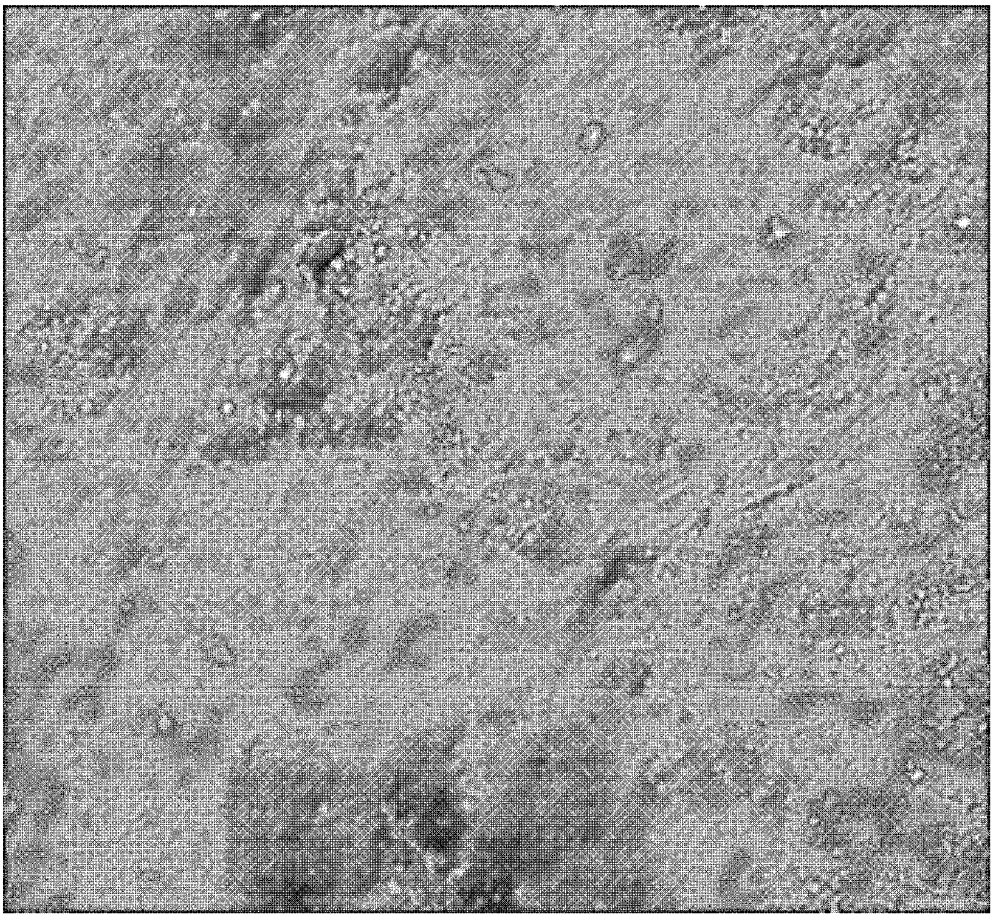
FIG. 6 is a photograph of a surface of a material after anodizing and full sealing according to a conventional method.

FIG. 6 is a photograph of a surface of a material after anodizing and full sealing according to a conventional method.

In the case of products treated using anodizing as a final process according to a conventional method, it is common to obtain desired corrosion resistance via full sealing treatment by immersing a material for 1 minute per 1 μm at 90° C. or above. Referring to FIGS. 3 and 6, by full sealing, all pores are closed so that coating material cannot permeate into the pores.

Therefore, some of the pores need to remain on the surface by a partial sealing process in which the concentration and temperature of a sealant are lowered and the immersing time is reduced such that the coating material permeate into the pores and the pores serve as anchors holding the coated layer.

Figure 7:
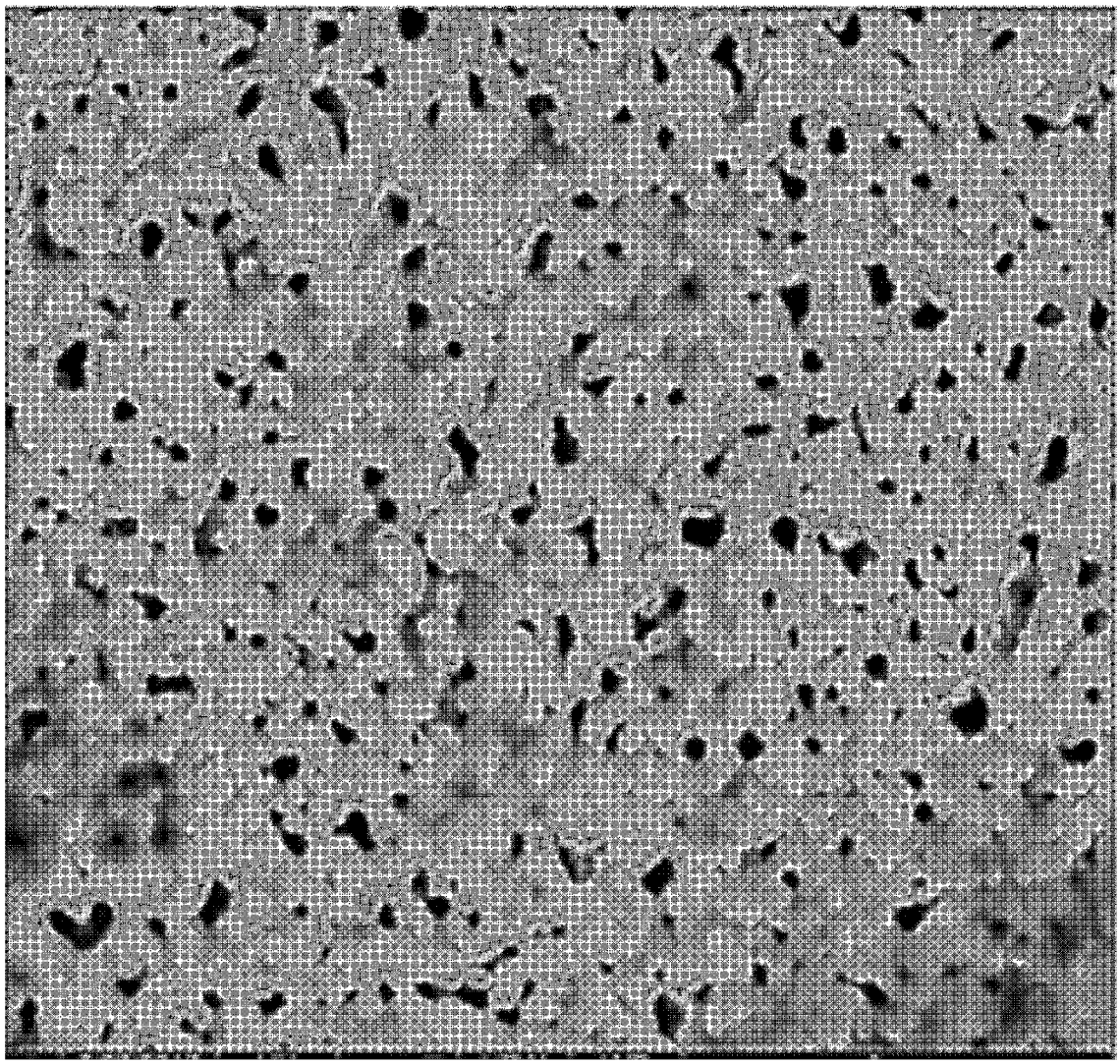
FIG. 7 is a photograph of a surface of a material after partial sealing according to an embodiment of the present disclosure.

FIG. 7 is a photograph of a surface of a material after partial sealing according to an embodiment of the present disclosure.

Figure 8:
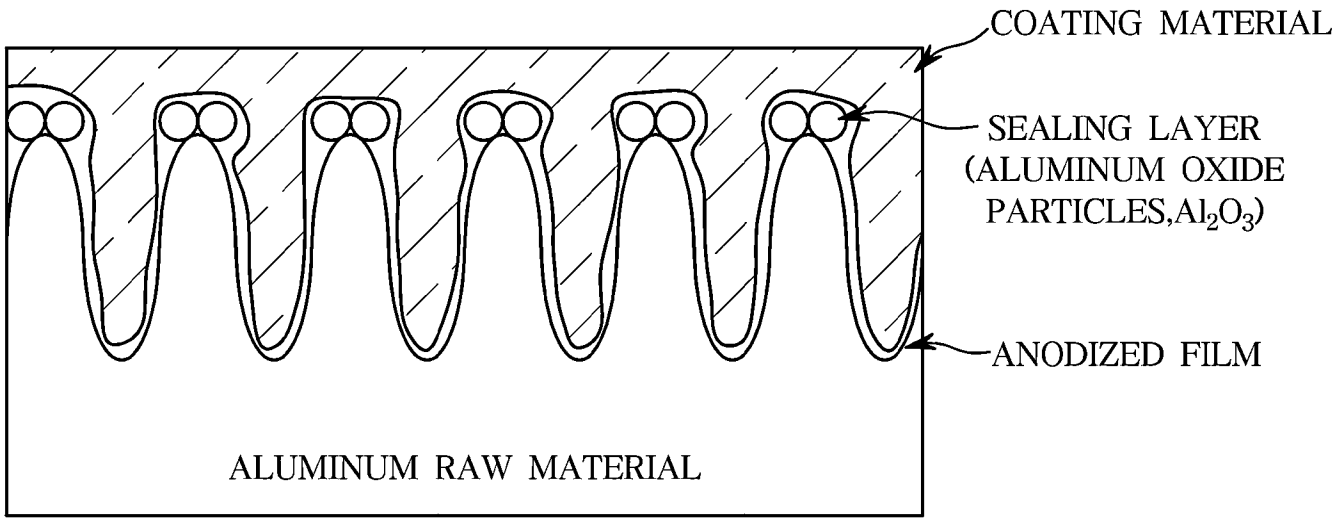
FIG. 8 is a schematic diagram illustrating a state in which pores are open by anodizing and partial sealing according to an embodiment of the present disclosure.

FIG. 8 is a schematic diagram illustrating a state in which pores are open by anodizing and partial sealing according to an embodiment of the present disclosure.

Referring to FIGS. 7 and 8, S760 may be a process of performing partial sealing treatment by lowering concentration and temperature of a sealant and decreasing an immersion time such that a coating material permeate into pores. In an embodiment, the sealing may be a process of immersing the aluminum material in a 3-5 wt % nickel acetate solution at a temperature in the range of 70 to 80° C. for a time in the range of 2 minutes to 4 minutes. By the sealing treatment, a sealing layer including aluminum oxide ($Al_2O_3$) particles may be formed.

After the coloring as described above, durability of the anodized film treated by sealing is affected by adhesion between the material and a layer formed thereon, and the formed layer should have a high adhesion to pass reliability test required for exterior materials.

By performing the partial sealing treatment instead of full sealing, the coating material may permeate into the pores and be partially filled therein on the surface of the aluminum raw material in a subsequent coating, so that the pores serve as anchors to increase adhesion of the coating material, improve corrosion resistance, and realize unique colors and particulate texture of the coating material.

A first drying process may be performed to dry the surface after the sealing treatment (S760). In an embodiment, the first drying process may be performed at a temperature in the range of 60 to 70° C. for a time in the range of 10 minutes to 20 minutes after the sealing.

Referring back to FIG. 4, S800 may be a coating process performed after the anodizing (S700) by various coating methods such as baking coating, electro-deposition coating, and powder coating.

After the coating (S800), a second drying process may be performed. In an embodiment, the second drying process may be performed at a temperature in the range of 145 to 150° C. for a time in the range of 30 minutes to 60 minutes after the coating.

FIG. 9 is a cross-sectional view of an aluminum material after surface treatment according to an embodiment of the present disclosure.

Referring back to FIG. 2, in the case where an aluminum material is surface-treated according to a conventional method, a primer layer, a color base coat layer, and a clear coat layer are formed on an aluminum raw material.

Referring to FIG. 9, in the case where an aluminum material is surface-treated according to an embodiment of the present disclosure, an anodized film, a primer layer, a color base coat layer, and a clear coat layer may be formed on an aluminum raw material. That is, by the surface treatment method according to an embodiment of the present disclosure, an aluminum material having excellent corrosion resistance as well as high surface hardness may be obtained by forming an anodized film thereon before coating.

Figure 10:
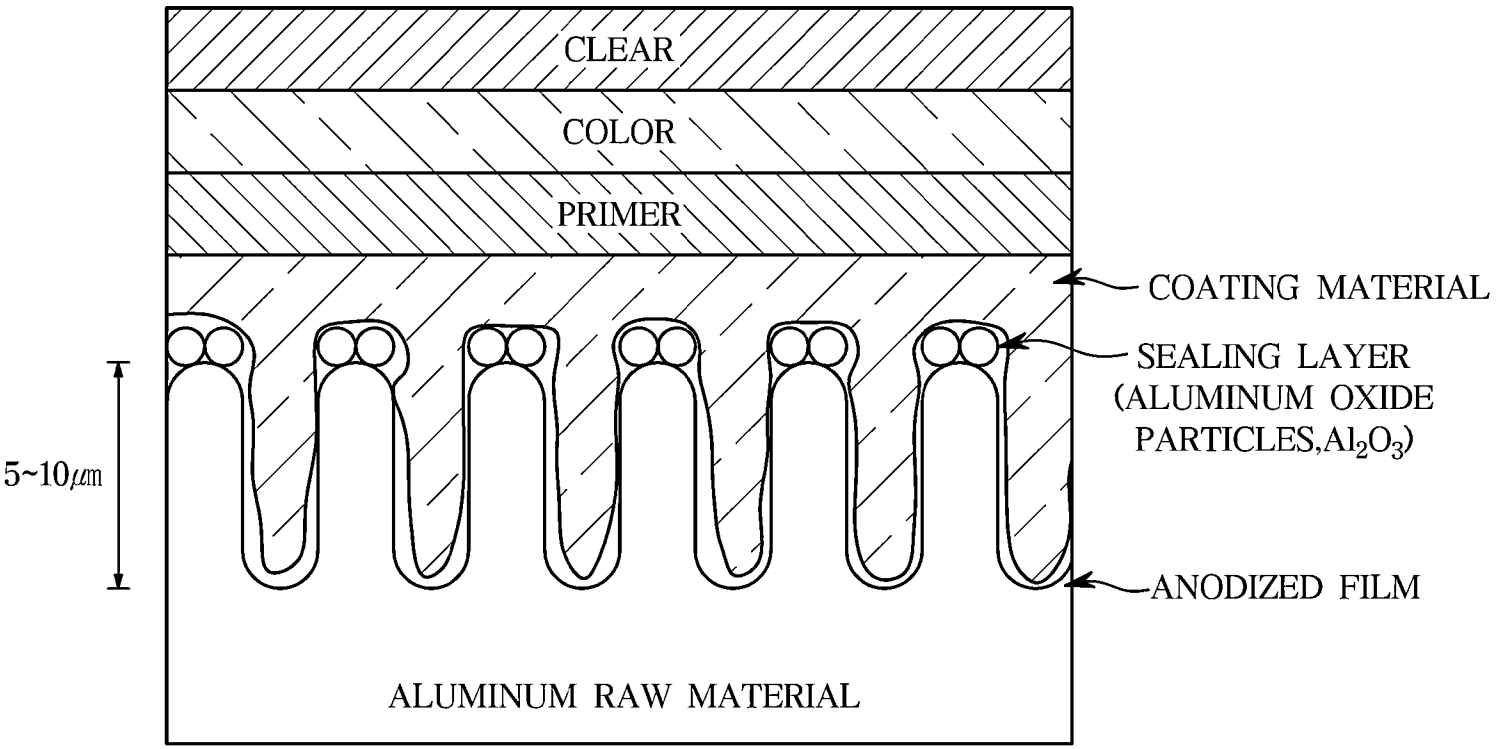
FIG. 10 is a cross-sectional view of an aluminum material after surface treatment according to an embodiment of the present disclosure.
Figure 11:
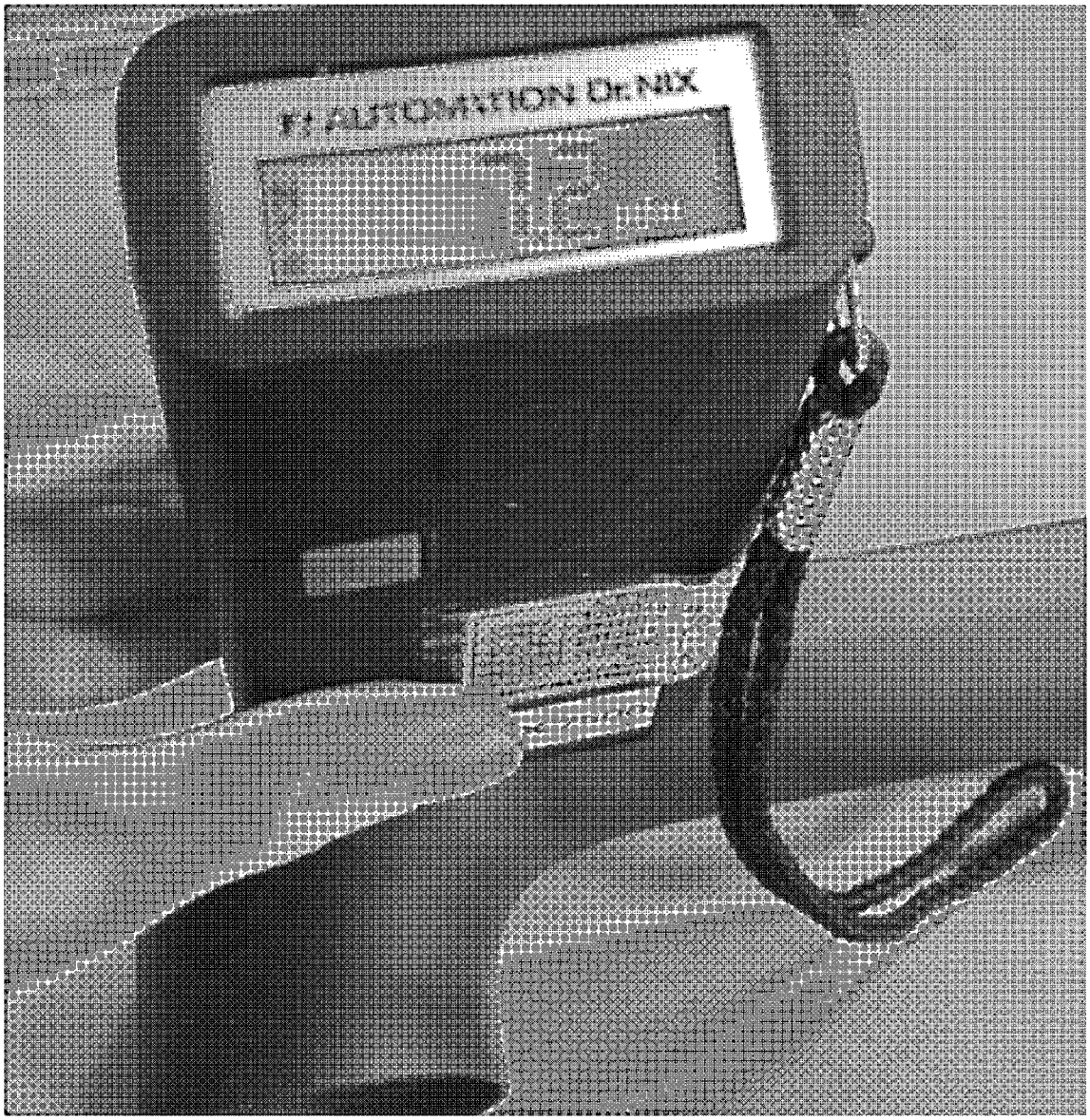
FIG. 11 is a photograph showing a thickness of a coated film of a product after surface treatment according to an embodiment of the present disclosure.

FIG. 10 is a cross-sectional view of an aluminum material after surface treatment according to an embodiment of the present disclosure.

Referring FIG. 10, a coating material may permeate into pores by increasing diameters of pores of the anodized film and performing partial sealing treatment on the anodized film. In this regard, the anodized film may have a thickness of 5 to 10 μm, a sealing layer including aluminum oxide ($Al_2O_3$) may be formed on the anodized film. In addition, the primer layer, the color base coat layer, and the clear coat layer may be formed on the coating material.

Hereinafter, the present disclosure will be described in more detail with reference to the following examples and comparative examples. However, the following examples are merely presented to exemplify the present disclosure, and the scope of the present disclosure is not limited thereto.

EXAMPLES

Products were prepared by baking coating and products were prepared by baking coating after anodizing surface treatment. In this regard, the anodizing was performed according to the order, processes, and conditions shown in Table 1 below. Then, a pencil hardness test and a salt fog test were conducted on the products obtained by baking coating and the products obtained by baking coating after anodizing surface treatment.

TABLE 1

| No. | Process | Conditions |
|---|---|---|
| 1 | decreasing | 10 wt % neutral degreasing agent, and 3 wt % sulfuric acid ($H_2SO_4$), 50 to 60° C., 30 sec |
| 2 | etching | 1 to 3 wt % sodium hydroxide (NaOH), 50 to 60° C., 10 to 20 sec |
| 3 | first desmutting | 25 to 30 wt % nitric acid ($HNO_3$), 25 to 30° C., 60 sec |
| 4 | second desmutting | 10 wt % nitric acid ($HNO_3$), 25 to 30° C., 30 sec |
| 5 | anodizing | 12 to 13 V, 24 to 26° C., 23 to 24 wt % sulfuric acid ($H_2SO_4$), 5 to 9 min |
| 6 | coloring | Direct immersion in dye |
| 7 | sealing | 3 to 5 wt % nickel acetate ($Ni(CH_3CO_2)_2$), at 70 to 80° C., 3 min |
| 8 | first drying | 60 to 70° C., 15 min |

<Pencil Hardness Test>

The pencil hardness test was performed under conditions of a 1 kg load and a speed of 50 mm/min. In Table 2, pencil hardness test results (1 H to 4 H) of the products obtained by baking coating and the products obtained by baking coating after anodizing surface treatment are shown. In Table 2 below, 'OK' means a case in which no scratches occurred on the surface, and 'NG' means a case in which scratches occurred on the surface.

TABLE 2

| | Pencil hardness test result (1H) | Pencil hardness test result (2H) | Pencil hardness test result (3H) | Pencil hardness test result (4H) |
|---|---|---|---|---|
| Baking-coated products | OK | OK | NG | NG |
| Baking-coated products after anodizing surface treatment | OK | OK | OK | OK |

Referring to Table 2 above, it was confirmed that the products obtained by baking coating after anodizing surface treatment had superior surface hardness to that of the products obtained by baking coating because the pencil hardness of the products obtained by baking coating was measured as 2H and the pencil hardness of the products obtained by baking coating after anodizing surface treatment was measured as 4H. Therefore, the baking-coating products after anodizing treatment was able to withstand the pencil hardness test without scratching, while the baking-coated products were not.

<Salt Fog Test>

A salt fog test was performed by repeating 20 cycles, each cycle including spraying 5 wt % sodium chloride (NaCl) for 8 hours and resting for 16 hours under the temperature conditions of 35° C.

Figure 12:
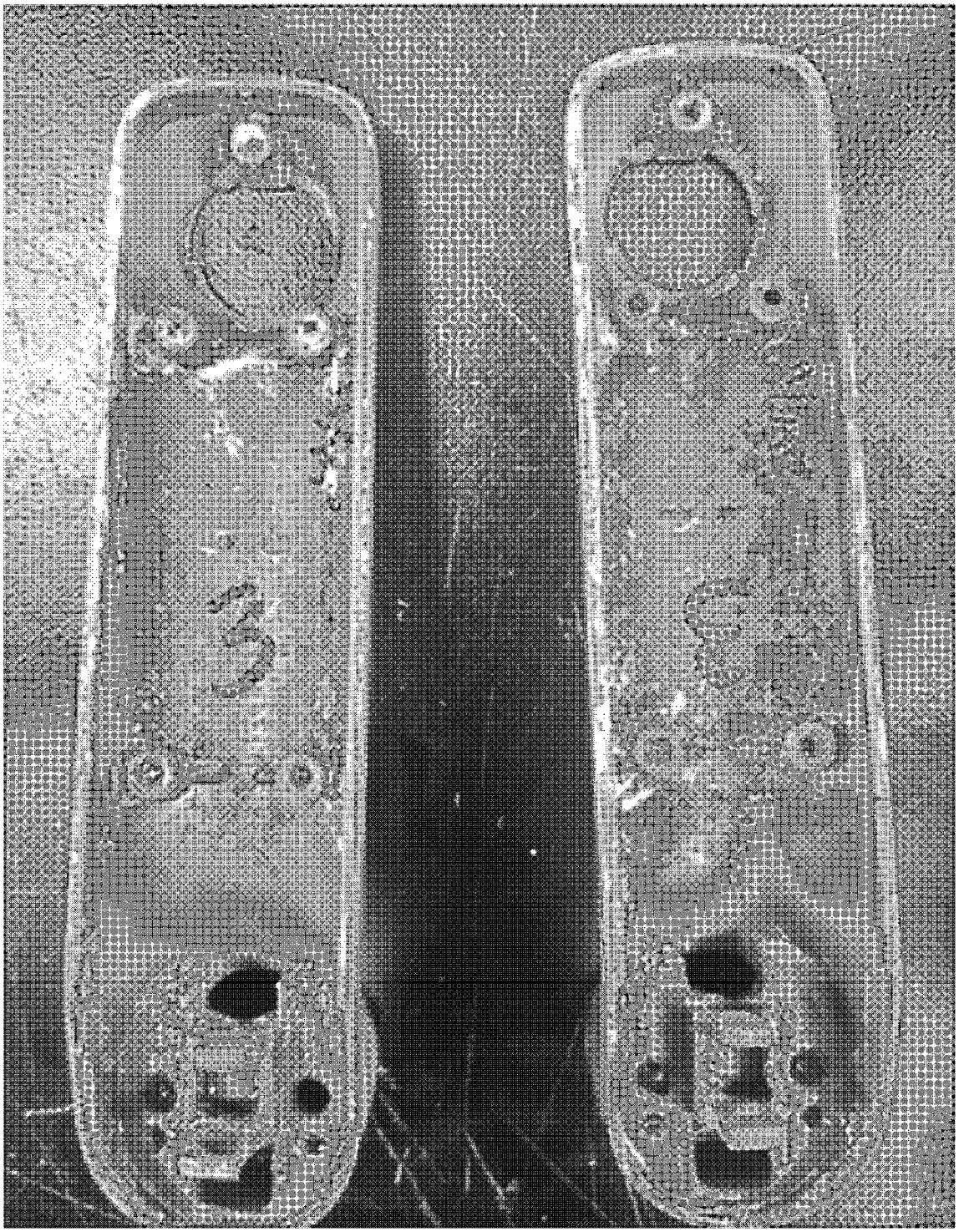
FIG. 12 is a photograph of products manufactured by conventional baking coating after a salt fog test.

FIG. 12 is a photograph of products manufactured by conventional baking coating after a salt fog test.

Referring to FIG. 12, it was confirmed that white rust was formed after 5 cycles on a raw material of the products manufactured by conventional baking coating.

Figure 13:
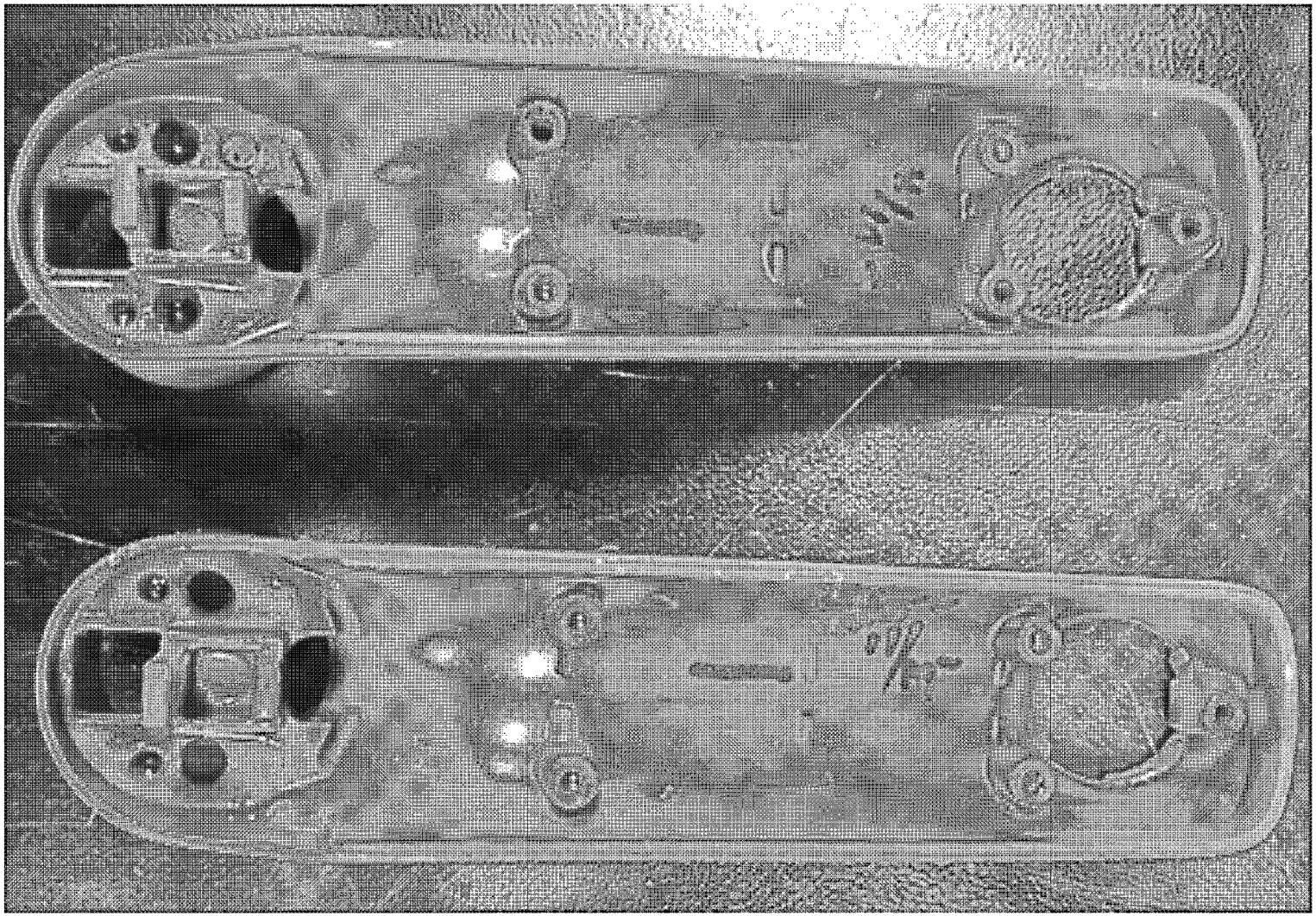
FIG. 13 is a photograph of products manufactured by baking coating after surface treatment according to an embodiment of the present disclosure after a salt fog test.

FIG. 13 is a photograph of products manufactured by baking coating after surface treatment according to an embodiment of the present disclosure after a salt fog test.

Referring to FIG. 13, white rust was not formed even after 20 cycles on the surface of the products surface-treated by anodizing before baking coating. Therefore, the products surface-treated by anodizing before baking coating have superior corrosion resistance when compared to the products manufactured by conventional baking coating.

According to the disclosed embodiments, it was confirmed that the products obtained by baking coating after anodizing surface treatment according to the present disclosure had superior surface hardness and corrosion resistance to those of the products obtained only by baking coating. Therefore, in the aluminum material to which the surface treatment method according to an embodiment of the present disclosure was applied, surface defects occurring while being used may be inhibited and delamination of the coated layer may be prevented. In addition, due to improved corrosion resistance even in a corrosive environment, the aluminum material may be applied to faucet products, and the like.

While one or more exemplary embodiments have been described with reference to the examples, the present disclosure is not limited to the above-described embodiments and it will be understood by those of ordinary skill in the art that various changes in form and details may be made therein without departing from the spirit and scope as defined by the following claims.

According to the present disclosure, a method of treating a surface of an aluminum material to improve adhesion of a coating material and remove impurities contained in the aluminum material as much as possible, compared to common coating methods, may be provided. Also, a method of treating a surface of an aluminum material to improve hardness and corrosion resistance as well as to obtain superior surface appearance may be provided.

What is claimed is:

1. A method of treating a surface of an aluminum material, the method comprising:

degreasing an aluminum material;

etching the degreased aluminum material;

performing a first desmutting treatment by immersing the etched aluminum material in a 25-35 wt % nitric acid solution at a temperature in a range of 25° to 30° C. for a time in a range of 60 seconds or more;

performing a second desmutting treatment by immersing the first desmutting-treated aluminum material in a 5-15 wt % nitric acid solution at a temperature in a range of 25° to 30° C. for a time in a range of 30 seconds to 60 seconds;

anodizing the second desmutting-treated aluminum material;

coloring the anodized aluminum material; and sealing the colored aluminum material.

2. The method according to claim 1, wherein the degreasing comprises cleaning the aluminum material in a solution comprising a neutral degreasing agent and 3 wt % sulfuric acid at a temperature in a range of 50° to 60° C.

3. The method according to claim 1, wherein the etching comprises immersing the degreased aluminum material in a 1-3 wt % sodium hydroxide solution at a temperature in a range of 50° to 60° C. for a time in a range of 10 seconds to 20 seconds.

4. The method according to claim 1, wherein the anodizing comprises immersing the second desmutting-treated aluminum material in a 23-24 wt % sulfuric acid solution at a temperature in a range of 24° to 26° C. for a time in a range of 5 minutes to 9 minutes and applying a voltage of 12 V to 13 V thereto.

5. The method according to claim 1, wherein after the anodizing, an oxide film is formed having a thickness between 3 μm and 8 μm.

6. The method according to claim 1, wherein the sealing comprises immersing the colored aluminum material in a 3-5 wt % nickel acetate solution at a temperature in a range of 70° to 80° C. for a time in a range of 2 minutes to 4 minutes.

7. The method according to claim 1, further comprising performing a first drying at a temperature in a range of 60° to 70° C. for a time in a range of 10 minutes to 20 minutes after the sealing.

8. The method according to claim 7, further comprising: coating after the first drying; and performing a second drying at a temperature in a range of 145° to 150° C. for a time in a range of 30 minutes to 60 minutes after the first drying.

9. The method according to claim 1, wherein the aluminum material is a die-cast aluminum material.

10. A method of treating a surface of an aluminum material, the method comprising:

degreasing the aluminum material;

etching the degreased aluminum material;

performing a first desmutting treatment by immersing the etched aluminum material in a first nitric acid solution to remove impurities and cause swelling of residual impurities;

performing a second desmutting treatment by immersing the first desmutting-treated aluminum material in a second nitric acid solution to remove the swelled residual impurities;

anodizing the second desmutting-treated aluminum material;

coloring the anodized aluminum material; and sealing the colored aluminum material, wherein the first nitric acid solution has a higher concentration than the second nitric acid solution.

11. The method according to claim 10, wherein the aluminum material is a die-cast aluminum material.

* * * * *